United States Patent [19]

Kelly et al.

[11] 4,207,984

[45] Jun. 17, 1980

[54] DECORATIVE ENVELOPE PACKET

[75] Inventors: Robert E. Kelly, Mahopac; Nathan Friedman, Hartsdale, both of N.Y.

[73] Assignee: Mill Printing and Lithographing Corporation, Peekskill, N.Y.

[21] Appl. No.: 965,151

[22] Filed: Nov. 30, 1978

[51] Int. Cl.[2] ..... B65D 85/54

[52] U.S. Cl. ..... 206/554; 206/451

[58] Field of Search ..... 206/425, 450–451, 206/526, 554, 806; 229/53; 248/95; 211/50, 57.1

[56] References Cited

U.S. PATENT DOCUMENTS

| | | | |
|---|---|---|---|
| 1,946,689 | 2/1934 | Haggerty | 206/451 |
| 2,077,664 | 4/1937 | Beardsley | 206/451 |
| 2,120,819 | 6/1938 | Steinthal | 206/450 |
| 2,178,404 | 10/1939 | Powter et al. | 206/450 |
| 3,608,712 | 9/1971 | Savoie | 206/554 X |

*Primary Examiner*—Herbert F. Ross
*Attorney, Agent, or Firm*—Anthony J. Casella

[57] ABSTRACT

A decorative envelope packet which may be mounted on a wall, and includes detachable envelopes in the form of a plurality of stacked envelopes encased within a decorative coverlayer. The coverlayer extends along the entire back portion of the envelopes and is connected by wire staples to the stacked flap portions of the envelopes. The decorative coverlayer is folded about three fold lines so as to completely enclose the wire staples, and so as to at least partially cover the flap portions of the front of the decorative envelope packet. The total enclosure of the wire staples ensures that during shipment of the decorative envelope packets the wire staples of one packet does not damage the decorative printing on the coverlayer of the adjacent packet, and in addition, this arrangement prevents inadvertent nicking or cutting of the user's fingers by the clinched ends of the wire staples.

6 Claims, 5 Drawing Figures

DECORATIVE ENVELOPE PACKET

The present invention relates to a new and improved decorative envelope packet including detachable envelopes and more particularly a decorative envelope packet wherein a plurality of stacked envelopes are encased within a decorative coverlayer having means for hanging the decorative envelope packet on the wall.

It has been known for charitable organizations to solicit funds for worthwhile causes over a period of time by providing to the contributor a packet of envelopes detachably encased within a decorative coverlayer having means for securing the packet to a wall. The decorative coverlayer provides an aesthetically pleasing picture to be viewed throughout the year, and the stack of envelopes are readily detachable from the coverlayer, and usually include indicia to remind the contributor at periodic times to consider a donation to the worthwhile charitable organization. For example, each envelope may be imprinted with one month of the year, and after that month passes, as the contributor removes the envelope bearing the past month, he is reminded to consider a further contribution.

Heretofore, the decorative coverlayer enclosing and mounting the plurality of envelopes usually consisted of a single sheet of coverboard material which is simply stapled to the ends of the flaps of the envelopes. The staples extend through the flaps, with the clinched free ends of the staples being exposed. The other folded portion of the decorative coverlayer overlaps the flap portions, and defines the front portion of the envelope packet, and usually includes a decorative picture or the like which, of course, is present throughout the year while the decorative packet is hung on the contributor's wall. The exposed clinched staples present several problems. One of the problems is that during the shipment, following printing of the decorative envelope packets, the packets are arranged in a stacked array, and thus the exposed clinched wire staples of one packet bears against, and rubs against the decorative picture on the coverlayer of the next lower packet. Accordingly, there is a potential for permanent damage to the decorative picture contained on the coverlayer of the lower packets, and in the stacked array of packets, all of the packets may be damaged during shipment, except for the uppermost packet. In addition, the contributor is susceptible to being injured because of the exposed clinched ends of the wire staples which could cut or scratch the contributor during the time that the decorative envelope packet is being handled and hung on a wall.

Accordingly, it is an object of the subject invention to overcome the shortcomings of the prior art devices, and provide a new and improved decorative envelope packet which totally encases the bonding means for securing the stack of envelopes to the decorative cover thereby precluding damage to the decorative picture on the packet, and also obviating the possibility of the contributor being injured by the exposed clinched ends of the wire staples.

The above and other objects and advantages are achieved through a decorative envelope packet which includes a plurality of stacked envelopes, the flap portions of which are aligned. An elongated, decorative coverlayer having first, second, and third intermediate, parallel fold lines extending perpendicular to the length of the coverlayer is provided over the stacked envelopes, and bonded thereto. The bonding means in the form of wire staples secures the flap portions of the envelopes to the coverlayer, and more particularly to the two folded-over portions of the coverlayer disposed on the opposite sides of the first fold line. The coverlayer is then folded about the second and third fold lines such that the coverlayer overlaps the entire back portion of the stacked envelopes, and in addition overlaps at least the flap portions of the front portion of the envelopes. The front portion of the coverlayer is provided with suitable indicia in the form of a picture or painting and the like, and the body or pocket portions of the envelope may likewise be printed.

Further objects and advantages of the invention will become apparent from the reading of the following detailed description taken in conjunction with the drawings in which.

Figure 1:
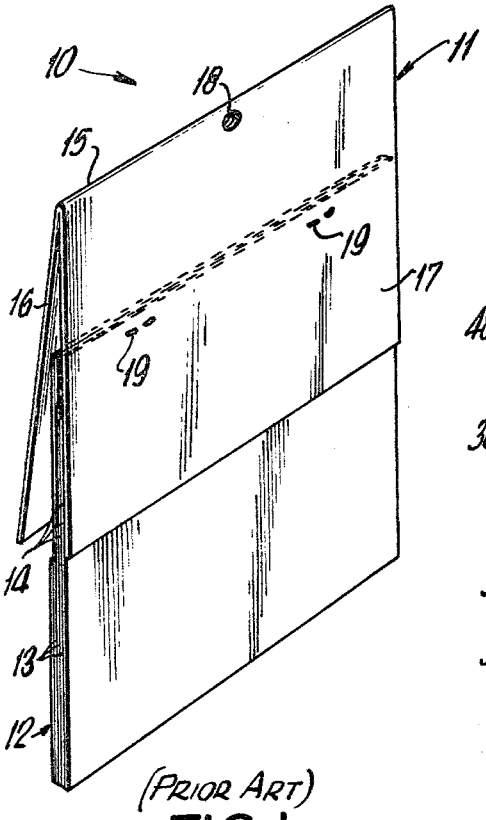
(PRIOR ART) FIG.1
FIG. 1 is a perspective view of a known decorative envelope packet made according to the prior art.
Figure 2:
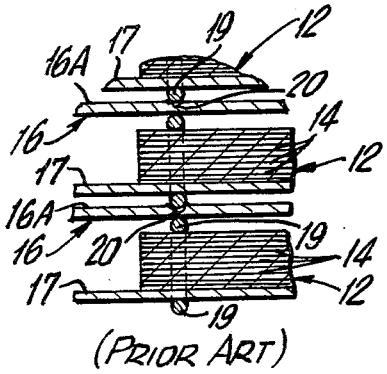
(PRIOR ART) FIG.2
FIG. 2 is a fragmentary view of the stacking of the prior art decorative envelope packets, and more particularly illustrating the potential damage to the envelope packets by virtue of the exposed wire staples.

Turning to FIGS. 1 and 2, a decorative envelope packet according to the prior art is designated by the numeral 10, and basically comprises a coverlayer 11, a stacked packet of envelopes 12, and wire staples 19. Each envelope includes a pocket portion 13 and a flap portion 14, with indicia normally being provided to the facing surface (not shown) of the pocket portion 13. The coverlayer 11 is folded about a single median fold line 15 to define a front panel 16 and a rear panel 17, and aligned holes 18 may be provided through the panels 16 and 17 adjacent the fold line 15 for hanging the decorative envelope packet on a wall surface. The plurality of stacked envelopes 12 is secured to the coverlayer 11 by means of wire staples 19 which extend through the ends of the flap portions 14 and connect to the rear panel 17. A decorative picture is usually imprinted on the outer surface 16A of the front panel 16.

As more particularly shown in FIG. 2, following printing and manufacturing of the decorative envelope packets, the latter are arranged in stacked array for shipment. In the stacked array of decorative envelope packets 10, it is seen that the exposed clinched ends of the wire staples 19 of a packet bear directly against the front surface 16A of the decorative envelope packet immediately disposed therebeneath. Thus, during handling and shipment it is possible that the closed wire staples 19 could rub against and gouge out, and therefore permanently damage, the decorative picture on the front face 16A of the front panel 16. The damage to the front face of the panel 16 is indicated in FIG. 2 by the reference numeral 20. In addition, as readily seen in FIG. 1, each decorative envelope packet 10 has exposed clinched ends of the wire staples 19, and the exposed wire staples could nick or cut the user of the decorative envelope packet as he is handling or mounting the packet to a wall.

Figure 3:
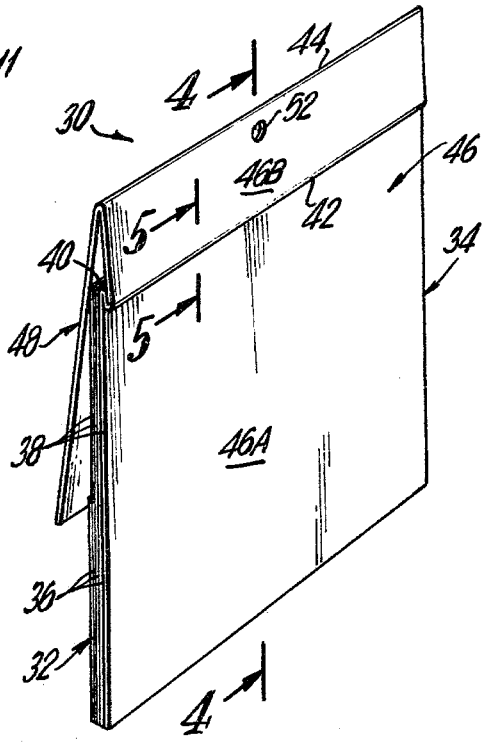
FIG. 3 is a perspective view of the new and improved decorative envelope packet made according to the subject invention.
Figure 4:
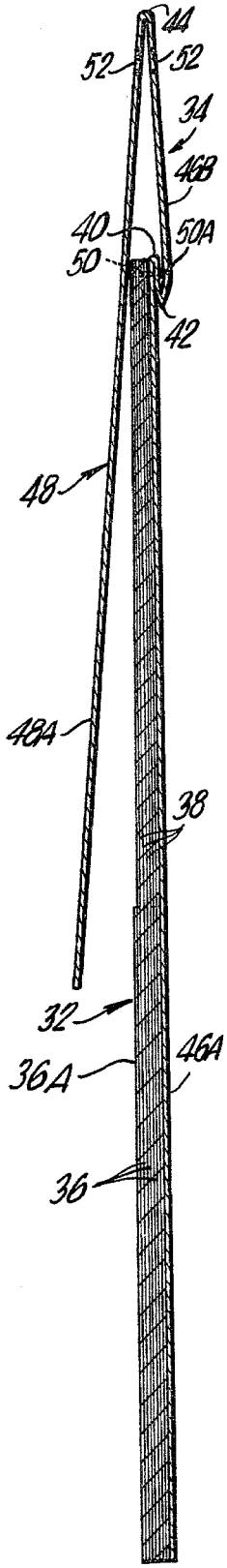
FIG. 4 is a sectional view taken along line 4—3 in FIG. 3.
Figure 5:
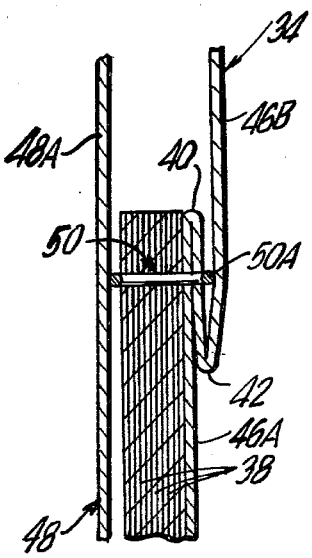
FIG. 5 is an enlarged partial sectional view taken along line 5—5 in FIG. 3.

Referring to FIGS. 3 through 5, the decorative envelope packet of the subject invention is designated by the numeral 30 and basically comprises a plurality of stacked envelopes 32, a coverlayer 34, and bonding means 50. Each envelope includes a pocket portion 36 which is provided with indicia on the front face thereof, designated by 36A, as well as a flap portion 38. The coverlayer 34 is preferably formed of a glossy paper and is of elongated rectangular configuration, of a width corresponding to the width of the envelopes 32. Coverlayer 34 is folded about a first fold line 40 extending along the median line disposed perpendicular to the length of the coverlayer 34. A second fold line 42 is spaced a relatively short distance from first fold line 40, while a third fold line is designated by the numeral 44. The fold lines 40, 42, and 44 are generally parallel.

In the assembly of the decorative envelope packet 30, the coverlayer 34 is first folded about the median first fold line 40, and then the coverlayer is secured to the flaps 38 of the stack of envelopes 32 by the bonding means, such as wire staples 50 which extend through the free ends of the flaps 38 and engage the overlapping portions of the coverlayer disposed between the first fold line 40 and the opposite free end of the coverlayer 34. The attachment of the wire staples 50 to the flaps 38 and the coverlayer is more particularly shown in FIG. 5. The coverlayer is then folded about the second fold line 42 to define an intermediate back panel portion between fold lines 40 and 42, and then about the third fold line 44, such that the coverlayer includes a back panel 46 and a front panel 48. The back panel 46 includes a lower panel portion 46A and an upper panel portion 46B; the latter being defined between the second and third fold lines. The remaining portion of the coverlayer extending between the third fold line 44 and the opposite end of the coverlayer defines the front panel 48 which is preferably printed with indicia, such as a picture or the like on its outer facing surface, designated by the numeral 48A.

As illustrated in FIG. 5 by virtue of the folding of the coverlayer 34, the clinched ends 50A of the wire staples 50 are totally encased within and surrounded by the folded over portions of the coverlayer 34. Accordingly, in the assembled condition of the decorative envelope packet, it is impossible for the free ends 50A of the staples 50 to cause damage or scratching to the contiguous decorative envelope packet when the packets are stored in a box for shipping, and subsequently handled. Furthermore, it is impossible for the clinched ends 50A of the staples 50 to injure or scratch a person when handling or mounting the decorative envelope packet to a wall. For purposes of mounting the decorative envelope packet, aligned holes 52 are provided through the upper back portion 46B and the front panel 48. As shown in FIGS. 3 and 4, the front panel 46 is of sufficient length to at least cover the flap portions 38 of the envelopes and still ensure that the printed indicia on the front facing surface 36A of the pockets 36 is clearly visible.

Although the invention has been described with respect to a specific embodiment thereof, it is readily apparent that various modifications, alterations or changes may be made by those skilled in the art without departing from the spirit and scope of the invention as defined by the appended claims.

What is claimed is:

1. In a decorative envelope packet including a plurality of stacked envelopes secured to an elongated, decorative coverlayer and wherein each envelope has a pocket portion and a flap portion, the improvement wherein said elongated cover layer has first, second and third parallel fold lines to consecutively define a front panel portion, an upper back panel portion, an intermediate back panel portion, and a lower back panel portion, said elongated coverlayer being disposed about the flap portions of the stacked envelopes such that the front panel portion overlies one side of the stacked flap portions of the envelopes, while the upper and lower back panel portions are disposed on the opposite side of the stacked flap portions of the envelopes, and said intermediate back panel portion is disposed between said upper and lower back panel portions and wherein a wire staple extends through the flap portions of the envelopes, as well as through the lower back panel portion and the intermediate back panel portion and is secured for fixing said stacked envelopes to the elongated coverlayer, and with the upper back panel portion overlying said secured staple thereby preventing the staple from causing injury to the user of the decorative envelope packet.

2. A decorative envelope packet as in claim 1 wherein the width of the coverlayer substantially corresponds to the width of the stacked envelopes.

3. A decorative envelope packet as in claim 1 wherein said first fold line is disposed in the middle of the length of said coverlayer.

4. A decorative envelope packet as in claim 1 wherein said coverlayer includes two aligned holes disposed symmetrically about said third fold line.

5. A decorative envelope packet as in claim 1 wherein said coverlayer is formed of a glossy paper and includes indicia thereon.

6. A decorative envelope packet as in claim 1 wherein said cover layer extends along the entire length of one side of the plurality of envelopes, and extends at least along a portion of the opposite side of said envelopes so as to at least enclose said flap portions thereof.

* * * * *